US009227163B2

(12) United States Patent
Krzywdziak

(10) Patent No.: US 9,227,163 B2
(45) Date of Patent: Jan. 5, 2016

(54) SYSTEM FOR STIRRING OR STORING PAINTS WITH ROLLER DRIVE ARRANGEMENT

(71) Applicant: AEML, Meung-sur Loire (FR)

(72) Inventor: Alain Krzywdziak, Orleans (FR)

(73) Assignee: AEML, Meung-sur Loire (FR)

( * ) Notice: Subject to any disclaimer, the term of this patent is extended or adjusted under 35 U.S.C. 154(b) by 0 days.

(21) Appl. No.: 14/370,238

(22) PCT Filed: Oct. 23, 2012

(86) PCT No.: PCT/EP2012/070962

§ 371 (c)(1),
(2) Date: Sep. 23, 2014

(87) PCT Pub. No.: WO2013/104443

PCT Pub. Date: Jul. 18, 2013

(65) Prior Publication Data

US 2015/0023129 A1 Jan. 22, 2015

(30) Foreign Application Priority Data

Jan. 10, 2012 (FR) ..... 12 50234

(51) Int. Cl.
*B01F 9/02* (2006.01)
*B01F 9/00* (2006.01)
(Continued)

(52) U.S. Cl.
CPC ..... *B01F 9/0016* (2013.01); *B01F 3/1221* (2013.01); *B44D 3/06* (2013.01); *B01F 2215/005* (2013.01)

(58) Field of Classification Search
CPC ..... B01F 3/1221; B01F 9/0016; B01F 2215/005; B44D 3/06
USPC ..... 366/197–198, 242–251, 213–214, 605
See application file for complete search history.

(56) References Cited

U.S. PATENT DOCUMENTS 2,006,451 A * 7/1935 Glidden ..... 366/213
3,711,379 A * 1/1973 Adams ..... 435/303.3
(Continued)

FOREIGN PATENT DOCUMENTS

DE 10227105 A1 1/2004
EP 143145 A2 * 6/1985 ..... B65G 1/02
(Continued)

*Primary Examiner* — Charles Cooley
(74) *Attorney, Agent, or Firm* — Dinsmore & Shohl LLP

(57) ABSTRACT

The present invention relates to a system (0) for stirring or storing paint contained in at least one cylindrical container (1). The system (0) includes at least one series (2×1; 2×2) of cylindrical rollers (2*a*1, 2*b*1; 2*a*2, 2*b*2) regularly aligned on at least one mounting (31, 32), wherein the cylindrical rollers (2*a*1, 2*b*1; 2*a*2, 2*b*2) have mutually parallel, inclined axes. At least one cylindrical roller (2*a*1; 2*a*2) from two adjacent cylindrical rollers (2*a*1, 2*b*1; 2*a*2, 2*b*2) is rotated about its axis by a drive system (4), the distance (d1, d2) between two adjacent cylindrical rollers (2*a*1, 2*b*1; 2*a*2, 2*b*2) being less than or equal to the diameter of a cylindrical container (1), such that the cylindrical surface of said container can bear on the cylindrical surface of two adjacent cylindrical rollers (2*a*1, 2*b*1; 2*a*2, 2*b*2). The stirring system (0) also includes at least one lid (5) for sealing the cylindrical container(s) (1), said lid (5) being provided with at least one removable blade (6) that extends into the cylindrical container (1) when the container (1) is closed by the lid (5).

15 Claims, 7 Drawing Sheets

Figure 1:
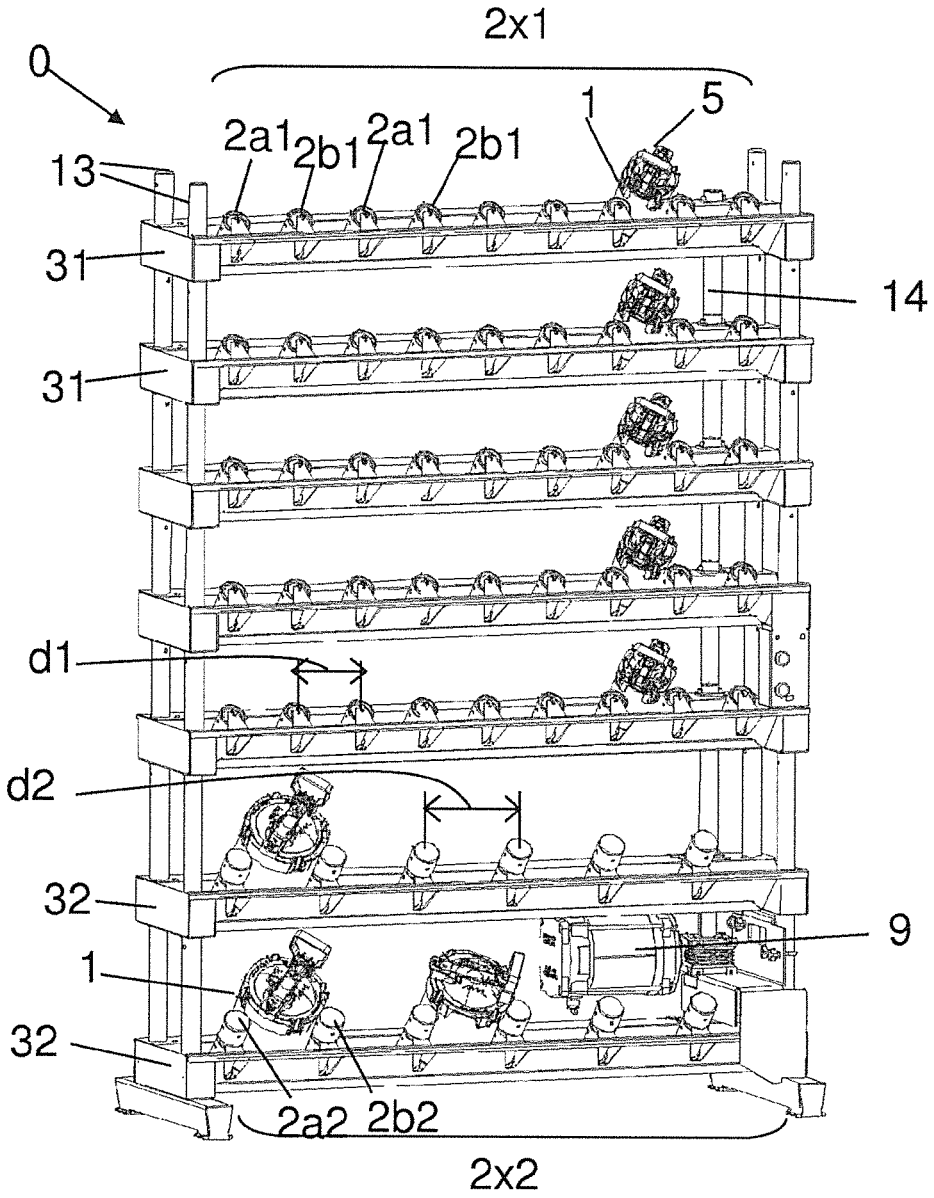

(51) Int. Cl.
*B01F 3/12* (2006.01)
*B44D 3/06* (2006.01)

(56) References Cited

U.S. PATENT DOCUMENTS 3,764,112 A * 10/1973 Jelley ..... 366/233
4,307,965 A * 12/1981 Catarious et al. ..... 366/208
4,526,215 A 7/1985 Harrison et al.
5,160,198 A * 11/1992 Fillon ..... 366/198
6,450,681 B1 * 9/2002 Nettelhoff et al. ..... 366/348
7,160,022 B2 * 1/2007 Krzywdziak et al. ..... 366/198
8,002,458 B2 * 8/2011 Naljotov ..... 366/217
2002/0145939 A1 * 10/2002 Keough ..... 366/247
2005/0041524 A1 * 2/2005 Krzywdziak et al. ..... 366/198
2006/0027580 A1 2/2006 Keough et al.
2007/0133348 A1 * 6/2007 Naljotov ..... 366/213
2007/0206437 A1 * 9/2007 Garcia et al. ..... 366/198
2008/0251478 A1 * 10/2008 Jaskowski ..... 211/74
2009/0279379 A1 * 11/2009 Gurney ..... 366/92
2012/0294110 A1 * 11/2012 Airaksinen ..... 366/213
2015/0023129 A1 * 1/2015 Krzywdziak ..... 366/198

FOREIGN PATENT DOCUMENTS

EP 0409715 A1 1/1991
FR 2521493 A1 8/1983

* cited by examiner 7
8
4a1
4a1
4a1
4a1
4a1
4a1
4a1
3a1
3a1
3

SYSTEM FOR STIRRING OR STORING PAINTS WITH ROLLER DRIVE ARRANGEMENT

CROSS-REFERENCE TO RELATED APPLICATIONS

This application is the U.S. National Phase of PCT/EP2012/070962 filed Oct. 23, 2012, which claims priority of French Patent Application 1250234 filed Jan. 10, 2012.

The present invention relates to the field of the paint especially for automobiles. The present invention relates more particularly to a system for stirring or storage a mixture of paints for automobile.

Repairing car bodywork needs application of paint in the final phase. When part of the vehicle is to be repainted, the shade applied must be identical to the original colour or the real colour at the time of repair.

Each repair does not necessarily consist of repainting the whole vehicle. When the colour of a vehicle has been degraded over time by ageing, the correct colour of a finely delimited zone has to be restored. An appropriate and optionally corrected formulation as a function of a colour-processing step or of the knowhow of the painter will be defined for repainting the vehicle.

Each vehicle has a reference corresponding to the colour of the automobile manufacturer. This reference displays on computer file, microfiche or catalogue of palette samples a recomposition formula of the colour from an array of mixed base tints.

The base of one hundred thousand formulas currently produced can be recomposed using 40 to 150 base tints of a line of paint from a manufacturer.

Generally, producing a formula is done using 3 to 10 base tints, the average being 5 base tints.

Base tints are a mix of pigments, lacquers and binders, such as resins, solvents and additives. For a formulated base tint to succeed properly, a precise dosage of the order of 0.05 g is needed, but also complete homogenisation of the coloured pigments in the binder. This is why it is necessary to carry out stirring of base tints before use to guarantee excellent restitution of their colour-processing powers. In fact, it is admitted that an array of base well homogenised tints enables correct recomposition of the tint to be created.

The normative development obliging paint manufacturers to reduce the quantity of solvents in base tints has encouraged them to innovate on the chemical components of paints and accordingly modify the physico-chemical structures of the latter. The effect of this is to reduce stirring time from 15 min to 5 min on stirring protocol, or even reduce stirring time to 0 min.

These days, some of these paints need no more stirring protocol, though they do need to be shaken before use, which can cause emulsion and therefore difficulties during dosage. Hardening of some tints over time is also noticed if they are not stirred.

There is currently an array of equipment for stirring and dosage according to a process set up by paint manufacturers.

There are already special cabinets comprising a mechanical transmission system on which are arranged pots of base tints fitted with a stirring/dosing cover. A stirring blade is driven mechanically following a rotation movement in the paint pot to carry out homogenisation per se. Dosing is done by means of a cover which is equipped with a pouring spout fitted with an automatic progressive opening and closing system enabling control of the pouring movements of a more or less large quantity of paint.

The aim of the present invention is to eliminate one or more disadvantages of the prior art by proposing a system for stirring or storing paint, which is economical silent and effective.

This aim is achieved by a system for stirring or storing paint contained in at least one cylindrical container, characterized in that it comprises at least one series of cylindrical rollers uniformly aligned on at least one support, the cylindrical rollers having axes parallel to each other and inclined, at least one cylinder roller on two adjacent cylinder rollers being driven by rotation about its axis by a drive system, the distance between two adjacent cylindrical rollers being less than or equal to the diameter of a cylindrical container so that the cylindrical surface of the container can rest on the cylindrical surface of two adjacent cylindrical rollers, the stirring system further comprising at least one cover adapted to hermetically seal the cylindrical container or cylindrical containers, the cover being fitted with at least one removable blade entering the cylindrical container when the container is closed by the cover.

According to another particular feature, the drive system comprises a drive pulley driving a belt, the drive system further comprising a plurality of pulleys connected to the cylindrical rollers driven by the belt, the belt being arranged alternatively on the right side of a first pulley of a cylindrical roller then on the left side of a second pulley of the adjacent cylindrical roller, given the drive direction of the belt, each of the pulleys connected to a cylindrical roller being followed and/or preceded by a pulley of cylindrical roller leaving its associated cylindrical roller free to rotate.

According to another particular feature, the drive system comprises a drive pulley driving a belt, the drive system further comprising a plurality of pulleys connected to the cylindrical rollers driven by the belt and a plurality of intermediate pulleys arranged between two pulleys connected to the cylindrical rollers, the belt being arranged alternatively on the right side of a pulley of a cylindrical roller then on the left side of an adjacent intermediate pulley given the drive direction of the belt, each of the pulleys of cylindrical roller driving its associated cylindrical roller.

According to another particular feature, the drive pulley is driven by a motor, the drive pulley having a vertical axis of rotation, the movement transmitted by the belt by the drive pulley being transmitted to the pulleys of cylindrical roller by way of at least one return pulley.

According to another particular feature, the belt is a belt of circular cross-section.

According to another particular feature, several supports each supporting a series of cylindrical rollers are arranged above each other, the space between each support allowing at least the passage of a container so that the container can be placed on two adjacent cylindrical rollers, the supports being mounted in the form of removable shelves held by common uprights, a shaft transmitting the rotation of the motor to the drive pulleys of each support.

According to another particular feature, the distance between two adjacent cylindrical rollers of a first series of cylindrical rollers is different to the distance between two adjacent cylindrical rollers of a second series of cylindrical rollers.

According to another particular feature, the motor is an electric motor transmitting a variable rotation speed to the drive pulley.

According to another particular feature, the axes of the cylindrical rollers are inclined by an angle of between 20° and 60° relative to a vertical axis.

According to another particular feature, the axes of the cylindrical rollers are inclined by 45° relative to a vertical axis.

According to another particular feature, the cylindrical rollers have a cylindrical surface covered with gripping material.

According to another particular feature, the support or the supports have a V-shaped cross-section with an angle of 90°, the V-shaped cross-section defining part of the support intended to receive the cylindrical rollers, a branch of the V being prolonged by a horizontal straight line, the horizontal straight line defining part of the support on which the drive pulley is fixed.

According to another particular feature, the cylindrical rollers comprise two cylindrical parts, a first cylindrical part intended to receive at least the peripheral surface of the cover with a diameter less than the diameter of the second cylindrical part intended to receive at least one part of the cylindrical surface of the container to which the cover is adapted.

According to another particular feature, the cover further comprises a variable-flow pouring-spout system controlled by a slide returned to a closed position by elastic means and whereof the open position is defined by a handle mounted in rotation on the cover and connected in displacement with the slide by a linkage rod.

According to another particular feature, the cover further comprises a grip yoke.

Figure 2:
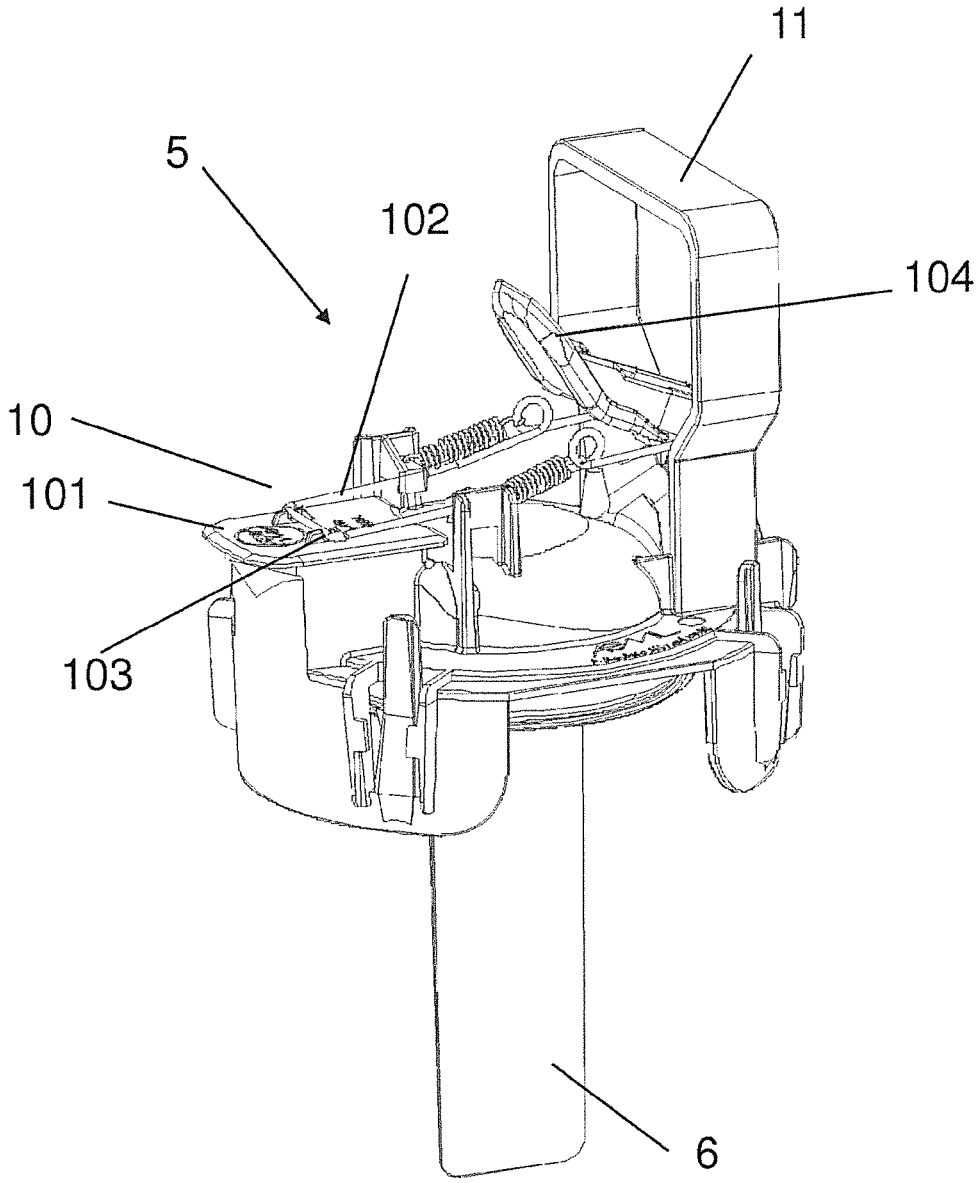
Figure 3:
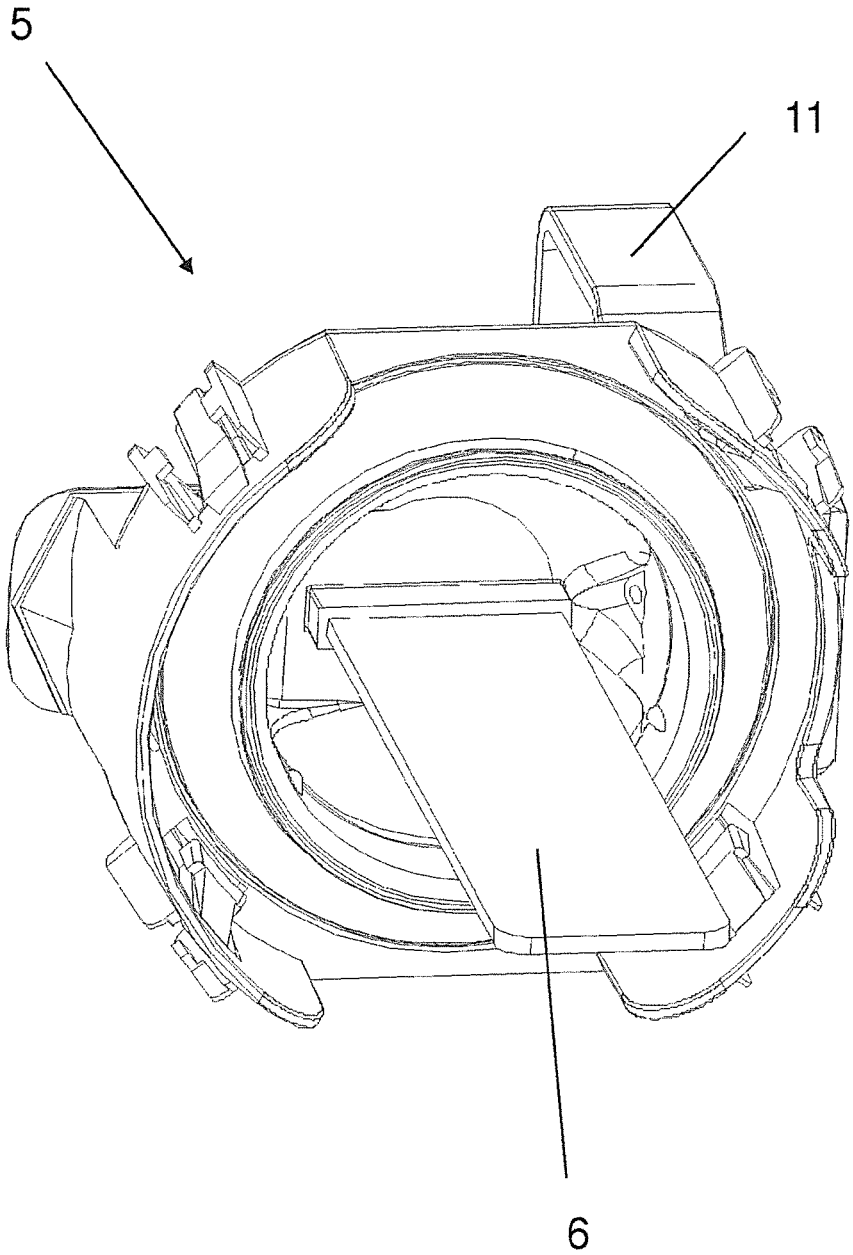
Figure 4:
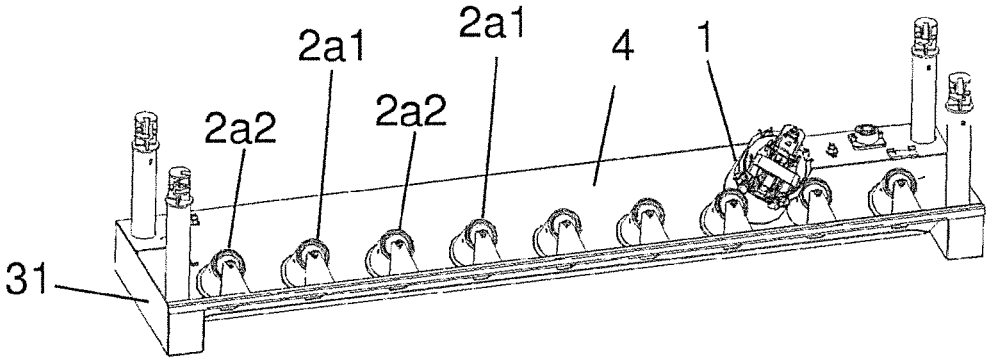
Figure 5:
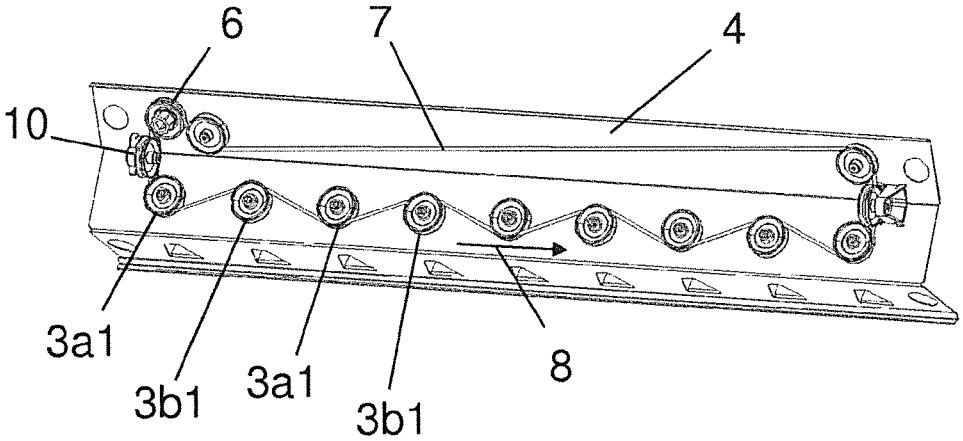
Figure 6:
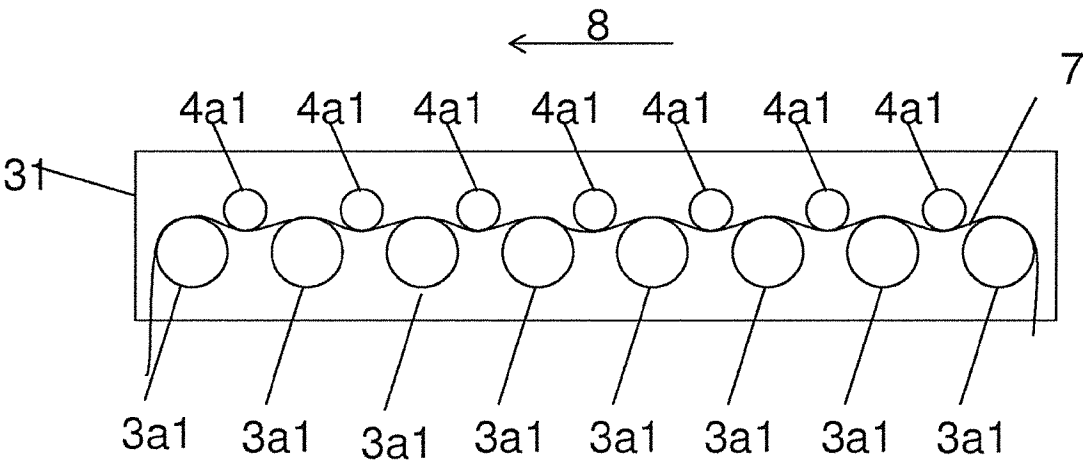
Figure 7:
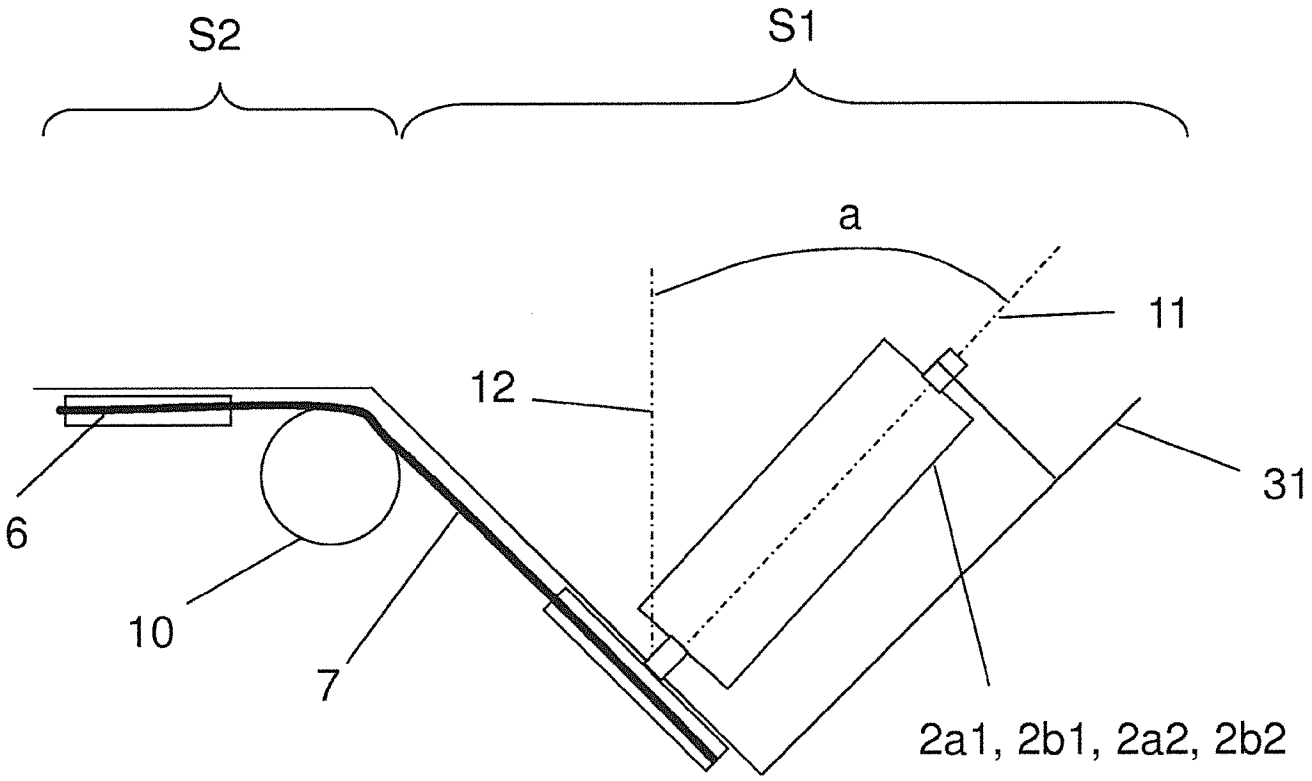
Figure 8:
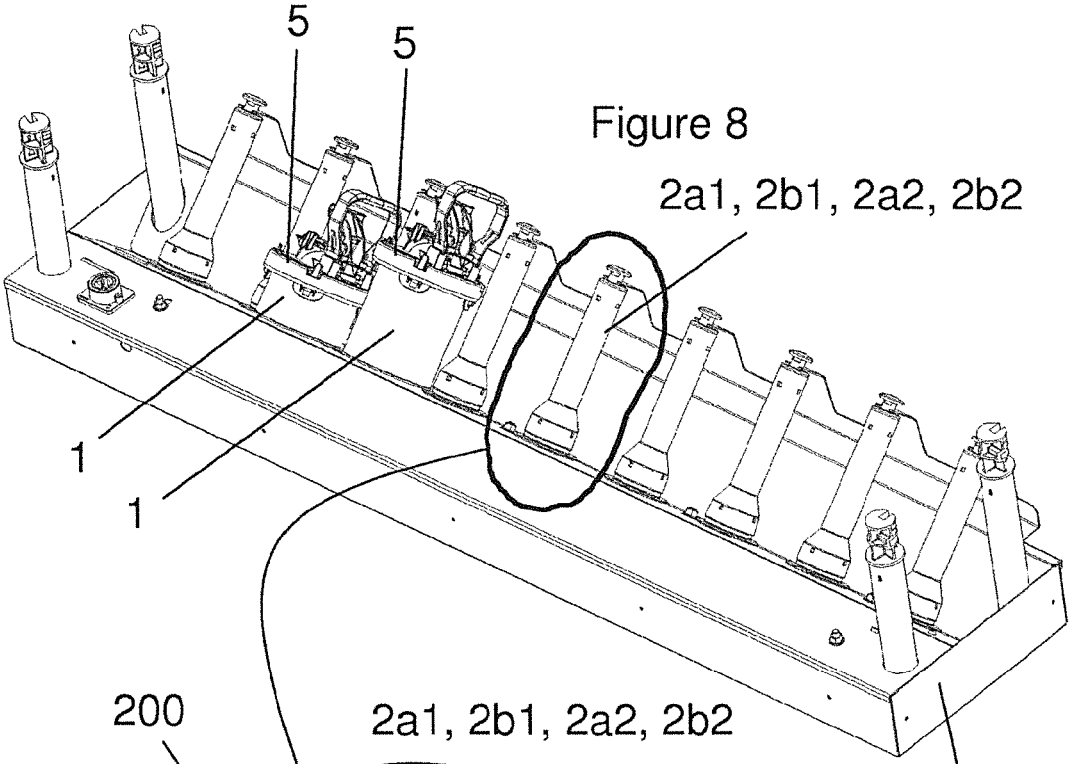
Figure 9:
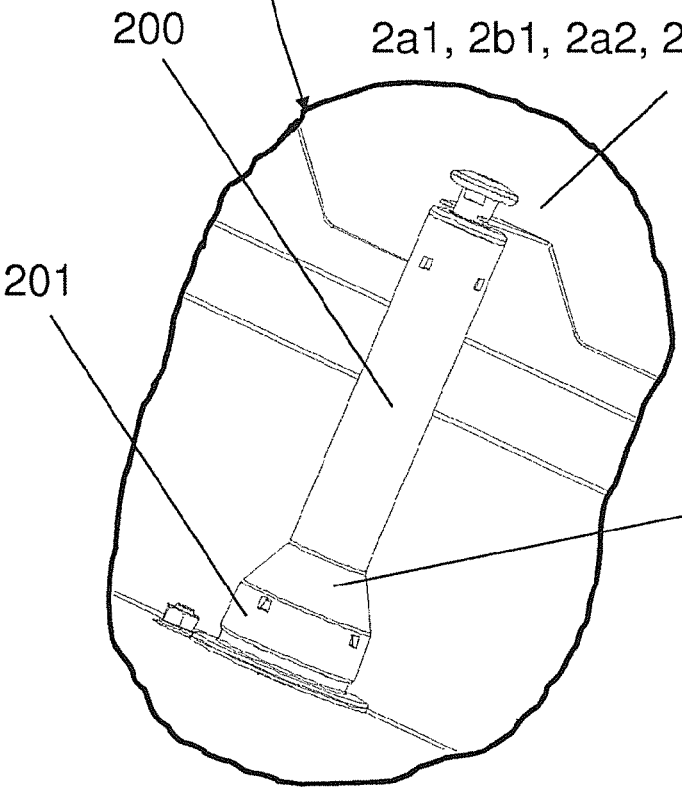

Other particular features and advantages of the present invention will emerge more clearly from the following description, given in reference to the attached drawings, in which:

FIG. 1 illustrates a perspective view of the system according to a configuration, FIG. 2 illustrates a perspective view of a cylindrical container fitted with a cover, FIG. 3 illustrates a perspective view of the cover of the side of the palette, FIG. 4 illustrates a closer perspective view of the system according to a configuration with a cylindrical container fitted with a cover, FIG. 5 illustrates a bottom plan view of the system showing the drive system of the cylinders according to a configuration, FIG. 6 illustrates a schematic view of the bottom of the system showing the position of the pulleys and belt of the drive system of the cylinders according to another configuration, FIG. 7 illustrates a transversal section of the system, FIG. 8 illustrates a perspective view of the system having rollers with two cylindrical parts, FIG. 9 illustrates a roller in the detail of FIG. 8.

Throughout the description, reference will be made to the figures listed hereinabove.

The invention relates to a system (0) for stirring or storing paint contained in at least one cylindrical container (1). A cylindrical container (1) can be a pot or a bottle containing paint, a base tint or base tints.

Stirring or storage is not unlike keeping the original homogeneity of colour pigments rather than the resuspending by stirring of these pigments. The effect of this storage will also have reducing impact on hardening during the period of use.

The system (4) comprises at least a series (2×1; 2×2) of cylindrical rollers (2*a*1, 2*b*1; 2*a*2, 2*b*2) uniformly aligned on at least one support (31, 32). The cylindrical rollers (2*a*1, 2*b*1; 2*a*2, 2*b*2) have axes parallel to each other.

These cylindrical rollers (2*a*1, 2*b*1; 2*a*2, 2*b*2) are inclined relative to a vertical axis (12) at an angle (a). In a non-limiting way, this angle (a) is between 20° and 60°, preferably 45°. The inclined position allows better circulation of the paint in the containers when the containers turn. It further improves the ergonomic conditions for handling containers.

At least one cylindrical roller (2*a*1; 2*a*2) of two adjacent cylindrical rollers (2*a*1, 2*b*1; 2*a*2, 2*b*2) is driven by rotation about its axis (11) by a drive system (4).

The distance (d1, d2) between two adjacent cylindrical rollers (2*a*1, 2*b*1; 2*a*2, 2*b*2) is less than or equal to diameter of a cylindrical container (1) so that the cylindrical surface of the container can rest on the cylindrical surface of two adjacent cylindrical rollers (2*a*1, 2*b*1; 2*a*2, 2*b*2). So that the cylindrical rollers (2*a*1, 2*b*1, 2*a*2, 2*b*2) can transfer their rotation to the containers resting on the latter, the cylindrical rollers (2*a*1, 2*b*1, 2*a*2, 2*b*2) have a cylindrical surface covered by gripping or slip-resistant material. The gripping material can be rubber or any other material for gripping the cylindrical surface of a cylindrical container so that the driven cylindrical rollers transfer their rotation to the container(s).

The rotation speed transmitted by the cylindrical rollers is constant irrespective of the diameter of the cylindrical containers.

For example, the rotation speed transmitted by the cylindrical rollers is of the order of 3 rpm to 15 rpm.

The diameter of the cylindrical rollers (2*a*1, 2*b*1; 2*a*2, 2*b*2) can be selected according to the rotation speed which can be transferred to the cylindrical containers. So, for the same rotation speed of the cylindrical rollers, the greater the diameter of the cylindrical rollers, the greater the rotation speed of the cylindrical container or cylindrical containers transferred by the cylindrical rollers.

The stirring system (0) further comprises at least one cover (5) adapted to hermetically seal the cylindrical container(s) (1). The closing of the cover (5) on the container or the containers (1) can be done by clipping, by screwing or any other means for fastening the cover onto the container. In a configuration, the cover (7) is provided with means for gripping onto the cover body which are clipped to the fitting crown of the container to be covered. The gripping means comprise two elastic fingers automatically supported against the annular surface of the crown when the body of the cover is positioned on the container.

The cover (5) is fitted with at least one blade (6) entering the cylindrical container (1) when the container (1) is closed by the cover (5). Preferably, the blade (6) is fixed to the centre of the cover (5). Preferably, the blade (6) has a length substantially equal to the depth of the cylindrical container (1). This blade (6) improves stirring of the paint in the container (1) during rotation of the container (1). According to a configuration, the blade (6) can be removable by clipping on the cover, for example. According to another configuration, the blade (6) can form a one-piece assembly with the cover (5).

According to a configuration, the cover (5) further comprises a variable-flow pouring-spout system (10). In a configuration, the variable-flow pouring-spout system comprises an outlet orifice, a closing element (101) flattened to block this orifice and drive means (102) of closing the element (101) in translation in said opening plane. The drive means (102) include a traction rod connected by fastening means (103) to the closing element and comprising an end portion attached to pushing means (104) driving said rod in the opening direction.

In a configuration, the variable-flow pouring-spout system (10) is controlled by a slide returned to a closed position by elastic means and whereof the open position is defined by a handle mounted in rotation on the cover and connected in displacement with the slide via a linkage rod.

According to a configuration, the cover (7) further comprises a grip yoke (11) for grasping the cover (7) alone or grasping the cover (7) with the container fixed to the cover (7). This grip yoke (11) also makes the pouring of the paint contained in the container easier. It also easily handles the pouring-spout system (10).

The cover (5) can have a peripheral cylindrical surface whereof the diameter is greater than the diameter of the cylindrical container (1) to which the cover (1) is adapted. So that the rollers effectively drive the container or the containers, the cylindrical rollers (2*a*1, 2*b*1, 2*a*2, 2*b*2) comprise two cylindrical parts (200, 201). A first cylindrical part (200) intended to contact at least the peripheral surface of the cover (5) with a diameter less than the diameter of the second cylindrical part (201) forming, for example, the base of the roller and intended to contact at least one part of the cylindrical surface of the container (1) to which the cover (5) is adapted. The difference in diameter of the two cylindrical parts of a cylindrical roller is, for example, equal to the difference between the diameter of the peripheral surface of the cover (5) and the diameter of the cylindrical surface of the container (1). The first part (200) of a roller can be connected to the second part (201) of the roller by a truncated part (202). The base of the truncated part (202) has a surface which can be equal to the surface of the transversal cross-section of the second part (201). The apex of the truncated part (202) has a surface which can be equal to the surface of the transversal cross-section of the first part (200). To adapt to several types of container/cover assemblies, the surface of the rollers can be removable to change the dimensions of the first cylindrical part and the second cylindrical part of the roller.

According to a first configuration (FIG. 5), the drive system (4) comprises a drive pulley (6) driving a belt (7). The drive system (4) further comprises a plurality of pulleys (3*a*1, 3*a*2) connected to the cylindrical rollers driven by the belt (7). Given the drive direction (8) of the belt (7), the belt (7) is arranged alternatively to the right side of a first pulley (3*a*1) of a cylindrical roller then to the left side of a second pulley (3*a*2) of the adjacent cylindrical roller. Each of the pulleys (3*a*1, 3*b*1) connected to a cylindrical roller (2*a*1, 2*b*1) is followed and/or preceded by a pulley (3*b*2) of cylindrical roller leaving its associated cylindrical roller (2*b*1) free to rotate. Therefore, while a container (1) rests on two adjacent cylindrical rollers, the cylindrical roller (2*a*1) driven by its associated pulley (3*a*1) turns the cylindrical container (1) about its axis. The cylindrical roller (2*b*1) left free in rotation by its associated pulley (3*b*2) serves as support to the container (1) which itself transfers rotation to this cylindrical roller left free in rotation.

According to a second configuration (FIG. 6) the drive system (4) comprises a drive pulley (6) driving a belt (7). The drive system (4) further comprises a plurality of pulleys (3*a*1) connected to the cylindrical rollers driven by the belt (7) and a plurality of intermediate pulleys (4*a*1) arranged between two pulleys (3*a*1) connected to the cylindrical rollers. Given the drive direction (8) of the belt (7), the belt (7) is arranged alternatively to the right side of a pulley of a roller of a cylinder then to the left side of an adjacent intermediate pulley (4*a*1). Each of the pulleys (3*a*1) of a cylinder is connected to a cylindrical roller and drives its associated cylindrical roller. The intermediate pulleys (4*a*1) stretch the belt (7) and press the belt against the pulleys (3*a*1) of the cylindrical roller so that transmission of the movement by the belt (7) can be provided fully to the pulleys (3*a*1) of a cylindrical roller.

Other configurations are feasible so that the cylindrical containers (1) can turn about their axis.

The belt (7) is a belt of circular cross-section. But other forms of belts are feasible, such as a synchronous belt.

The drive pulley (6) is driven by a motor (9). In a configuration, the drive pulley (6) has a vertical axis of rotation, whereas the cylindrical rollers (2*a*1, 2*b*1; 2*a*2, 2*b*2) have an axis inclined relative to the vertical. In this way, a return pulley (10) transfers movement transmitted by the belt (7) by the drive pulley (6) to the pulleys (3*a*1, 3*b*1) of cylindrical roller.

In a configuration, the motor (9) is an electric motor transmitting a variable rotation speed to the drive pulley (6).

In a configuration, several supports (31, 32) each supporting a series (2×1, 2×2) of cylinders are arranged above each other. The space between each support allows at least the passage of a container so that the container (1) can be placed on two adjacent cylindrical rollers. The supports (31, 32) are mounted in the form of removable shelves held by common uprights (13). A shaft (14) transfers the rotation of the motor to the drive pulleys (6) of each support.

In a configuration, the distance (d1) between two adjacent cylindrical rollers (2*a*1, 2*b*1) of a first series (2×1) of cylindrical rollers is different to the distance (d2) between two adjacent cylindrical rollers (2*a*2, 2*b*2) of a second series (2×2) of cylindrical rollers. The distance d1 between two adjacent cylindrical rollers (2*a*1, 2*b*1) of a first series (2×1) of cylindrical rollers can be, for example, smaller than the distance d2 between two adjacent cylindrical rollers (2*a*2, 2*b*2) of a second series (2×2) of cylindrical rollers. So, cylindrical containers (1) of small diameters could be arranged on the first series (2×1) of cylindrical rollers, while containers (1) of larger diameters could be arranged on the second (2×2) series of cylindrical rollers. The stirring or storage system can comprise a plurality of supports supporting a plurality of series of cylindrical rollers. Each series of cylindrical rollers could have distances between each cylindrical roller different from one series to the other.

According to a configuration, the support or the supports (4) have a V-shaped cross-section (S1) with an angle of 90°. The V-shaped cross-section defines part of the support intended to receive the cylindrical rollers. One branch of the V is prolonged by a horizontal straight line (S2) which defines part of the support on which the drive pulley (6) is fixed.

This system maintains viscosity over time by eliminating the thixotropic effects of paint, eliminates emulsion during a shaking operation, prevents paint from hardening after opening a container of new paint, improves the ergonomy of existing stirring systems, reduces motor power to be used due to low rotation speed, decreases the noise level of the system, eliminates the possibility of leaks when containers are closed by covers which is a recurring problem with classic systems, improves the grip of covers by the yoke and no longer a handle as in classic systems and can put in place bottles of paint and not only pots.

The present description details different embodiments and configurations in reference to figures and/or technical characteristics. Those skilled in the art will understand that the various technical characteristics of the various modes or configurations can be combined together, unless specifically stated otherwise or these technical characteristics are incompatible. Similarly, a technical characteristic of an embodiment or a configuration can be isolated from the other technical characteristics of this embodiment unless stated otherwise. In the present description, many specific details are provided by way of illustration and non-limiting, so as to detail the invention. Those skilled in the art will understand however that the invention can be carried out in the absence of one or more of these specific details or with variants. On other occasions, some aspects are not detailed so as to avoid obscuring and weighing down the present description and the man skilled in the art will understand that various and varied means could be utilised and that the invention is not limited to the examples described.

It must be evident for those skilled in the art that the present invention enables embodiments in many other specific forms without departing from the field of application of the invention as claimed. Consequently, the present embodiments must be considered by way of illustration, but can be modified in the field defined by the scope of the attached claims, and the invention must not be limited to the details given hereinabove.

The invention claimed is:

1. The system for stirring or storing paint contained in at least one cylindrical container comprising at least one series of cylindrical rollers uniformly aligned on at least one support, the cylindrical rollers having axes parallel to each other and inclined, at least one cylinder roller of two adjacent cylinder rollers being driven by rotation about its axis by a drive system, the distance between two adjacent cylindrical rollers being less than or equal to diameter of the at least one cylindrical container so that the cylindrical surface of the at least one container can rest on the cylindrical surface of two adjacent cylindrical rollers, the stirring system further comprising at least one cover adapted to hermetically seal the cylindrical container(s), the cover being fitted with at least one removable blade entering the at least one cylindrical container when the at least one container is closed by the cover.

2. The system according to claim 1, wherein the drive system comprises a drive pulley driving a belt, the drive system further comprising a plurality of driven pulleys connected to the cylindrical rollers driven by the belt, the belt being arranged alternatively to the right side of one driven pulley of one cylindrical roller then to the left side of a another driven pulley of the adjacent cylindrical roller, given the drive direction of the belt, each of the driven pulleys being associated with an associated cylindrical roller of said cylindrical rollers being followed and/or preceded by an undriven pulley of an undriven cylindrical roller leaving its associated driven cylindrical roller free to rotate.

3. The system according to claim 2, wherein the drive pulley is driven by a motor, the drive pulley having a vertical axis of rotation, the movement transmitted by the belt by the drive pulley being transmitted to the pulleys of said cylindrical rollers by way of at least one return pulley.

4. The system according to claim 2, wherein said belt has a circular cross-section.

5. The system according to claim 1, wherein the drive system comprises a drive pulley driving a belt, the drive system further comprising a plurality of driven pulleys connected to the cylindrical rollers driven by the belt and a plurality of intermediate pulleys arranged between two pulleys connected to the cylindrical rollers, the belt being arranged alternatively to the right side of a pulley of a cylindrical roller then to the left side of an adjacent intermediate pulley given the drive direction of the belt, each of the pulleys of cylindrical roller driving its associated cylindrical roller.

6. The system according to claim 1, and comprising several vertically spaced apart supports, each supporting a series of said cylindrical rollers mounted to at least two of said supports, a space between adjacent supports allowing at least passage of the at least one cylindrical container so that the at least one cylindrical container can be placed on two adjacent cylindrical rollers, the supports being mounted in the form of removable shelves held by common uprights, a drive pulley associated with each support, a shaft which transmits rotation from a motor to the drive pulleys associated with each support.

7. The system according to claim 6, wherein the distance between said two adjacent cylindrical rollers of a first series of cylindrical rollers on one support is different to the distance between said two adjacent cylindrical rollers of a second series of cylindrical rollers on another support.

8. The system according to claim 6, wherein said motor is an electric motor transmitting a variable rotation speed to the drive pulleys.

9. The system according to claim 1, wherein the axes of said cylindrical rollers are inclined by an angle of between 20° and 60° relative to a vertical axis.

10. The system according to claim 1, wherein the axes of the cylindrical rollers are inclined by 45° relative to a vertical axis.

11. The system according to claim 1, wherein said cylindrical rollers each have a cylindrical surface covered with gripping material.

12. The system according to claim 1, wherein the support(s) have a V-shaped cross-section with an angle of 90°, the V-shaped cross-section defining a part of the support intended to receive the cylindrical rollers, a branch of the V being prolonged by a horizontal straight line, the horizontal straight line defining a part of the support on which a drive pulley is fixed.

13. The system according to claim 1, wherein the cylindrical rollers comprise two cylindrical parts, a first cylindrical part intended to receive at least the peripheral surface of the cover has a diameter of less than the diameter of the second cylindrical part intended to receive at least one part of the cylindrical surface of the container to which the cover is adapted.

14. The system according to claim 1, wherein the cover further comprises a variable-flow pouring-spout system controlled by a slide resiliently returned to a closed position and wherein an open position is defined by a handle mounted in rotation on the cover and connected in displacement with the slide by a linkage rod.

15. The system according to claim 1, wherein the cover further comprises a grip yoke.

* * * * *